United States Patent [19]

Crescas et al.

[11] 3,976,011

[45] Aug. 24, 1976

[54] INERTIAL ARMING DEVICE FOR A FUSE

[75] Inventors: Charles Crescas, East Meadow; Sorrell Weisman, Jackson Heights; Joseph Sharf, Valley Stream, all of N.Y.

[73] Assignee: Bulova Watch Company, Inc., New York, N.Y.

[22] Filed: Oct. 31, 1960

[21] Appl. No.: 67,151

[52] U.S. Cl. ..... 102/70.2 R; 102/76 R; 102/78

[51] Int. Cl.[2] ..... F42C 11/00; F42C 15/00

[58] Field of Search ..... 102/70.2, 18, 19.2, 102/76, 78

[56] References Cited

UNITED STATES PATENTS

| | | | |
|---|---|---|---|
| 2,486,362 | 10/1949 | O'Brien | 102/70.2 R |
| 2,915,013 | 12/1959 | Moorhead | 102/70.2 R |

*Primary Examiner*—Charles T. Jordan

EXEMPLARY CLAIM

1. A fuse suitable for use in a body to be accelerated toward a target area comprising a base, a solenoid including a spring-biased armature disposed in said base, an explosive train including in sequence a detonator disposed in said base, a lead plunger contained in said armature, a lead plug contained in said base, and a booster contained in said base, said explosive train being initially out of alignment by reason of the position of the lead contained in said armature, a powerweight linearly movable from a first position to a second position in response to acceleration of said body, said powerweight being in interlocking engagement with said armature when said powerweight is in said first position and said armature is in a position governed solely by the urging of its bias spring, an escapement connected to said powerweight through a gear train to govern the movement of said powerweight from said first position to said second position, a spring-biased fork member responsive to the position of said powerweight, said fork member being biased against said powerweight and serving to engage said armature as it is moved under the influence of said solenoid when said powerweight is in said first position, the movement of said powerweight to said second position permitting said fork member to move out of the path of said armature and into engagement with said powerweight in its second position to serve as a support therefor, such that said explosive train becomes aligned upon movement of the armature out of interlocking relationship with said powerweight, followed sequentially by movement of said powerweight from said first position to said second position, movement of said fork member out of the path of said armature, and movement of said armature whereby said explosive train is aligned and the fuse is armed.

4 Claims, 20 Drawing Figures

INVENTORS
CHARLES CRESCAS
SORRELL WEISMAN
JOSEPH SHARF
BY
Kenyon & Kenyon
ATTORNEYS

INVENTORS
CHARLES CRESCAS
SORRELL WEISMAN
JOSEPH SHARF

BY Kenyon & Kenyon
ATTORNEYS

INVENTORS
CHARLES CRESCAS
SORRELL WEISMAN
JOSEPH SHARF
BY Kenyon & Kenyon
ATTORNEYS

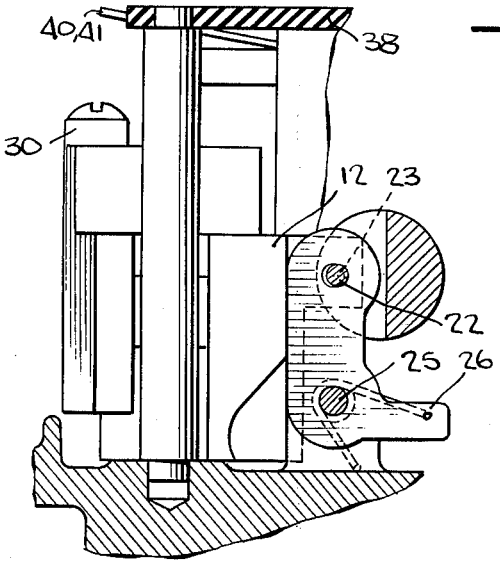
Fig. 8.
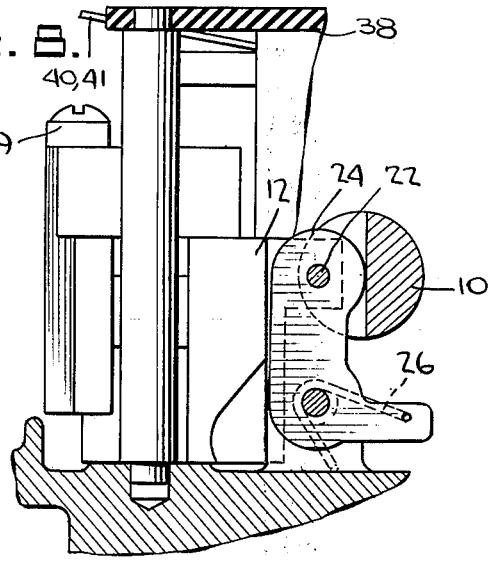
Fig. 6.
Fig. 12.
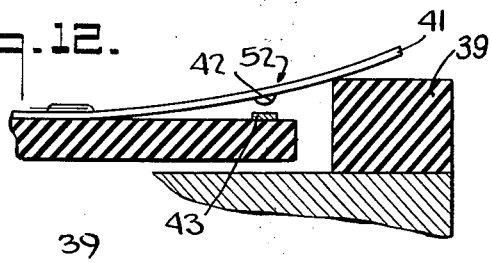
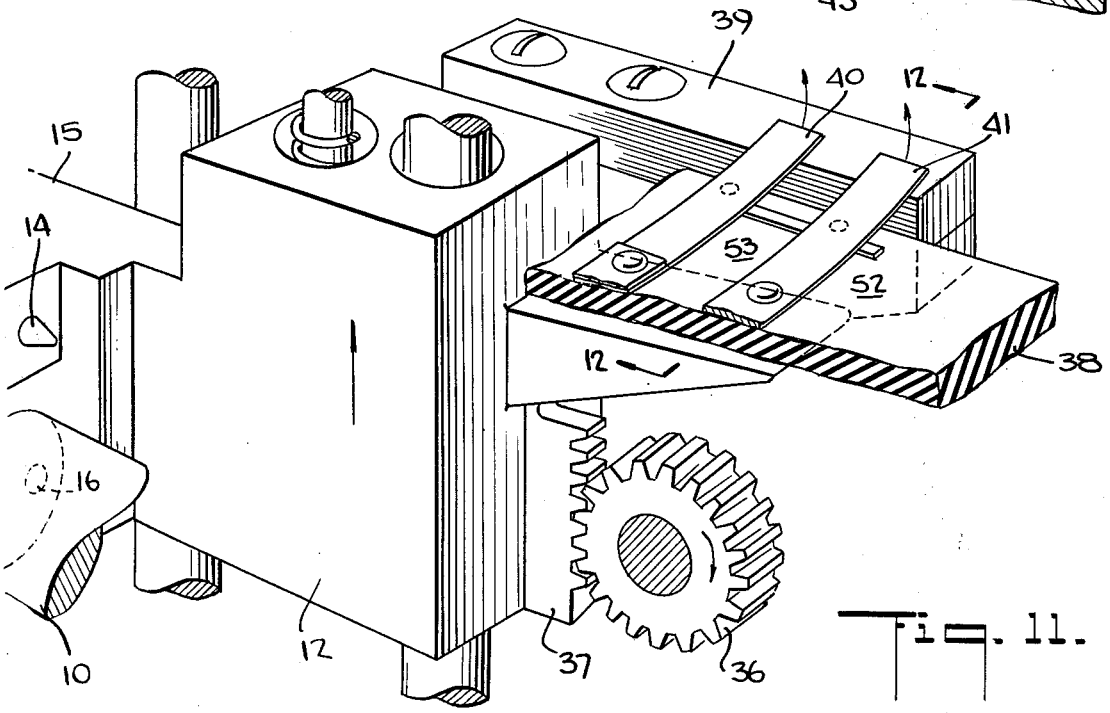
Fig. 11.
INVENTORS
CHARLES CRESCAS
SORRELL WEISMAN
JOSEPH SHARF
BY Kenyon & Kenyon
ATTORNEYS

INVENTORS
CHARLES CRESCAS
SORRELL WEISMAN
JOSEPH SHARF

BY Kenyon & Kenyon
ATTORNEYS

INVENTORS
CHARLES CRESCAS
SORRELL WEISMAN
JOSEPH SHARF
BY
Kenyon & Kenyon
ATTORNEYS

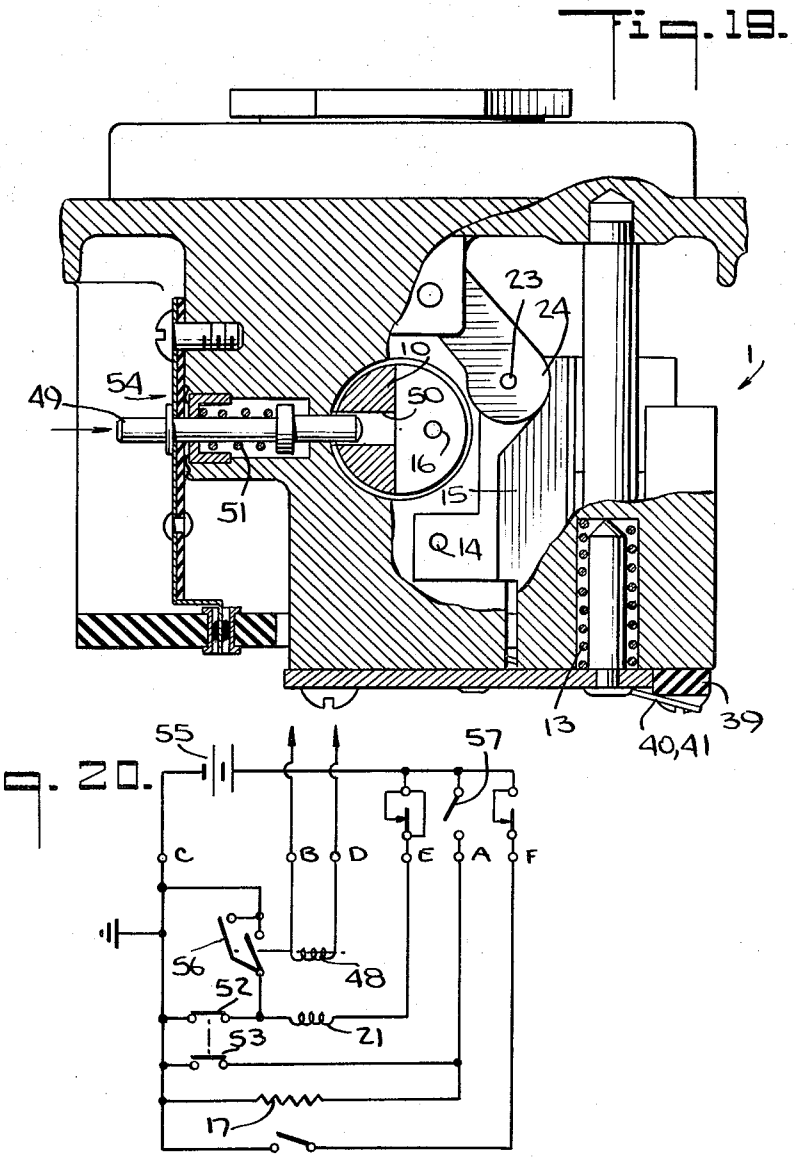
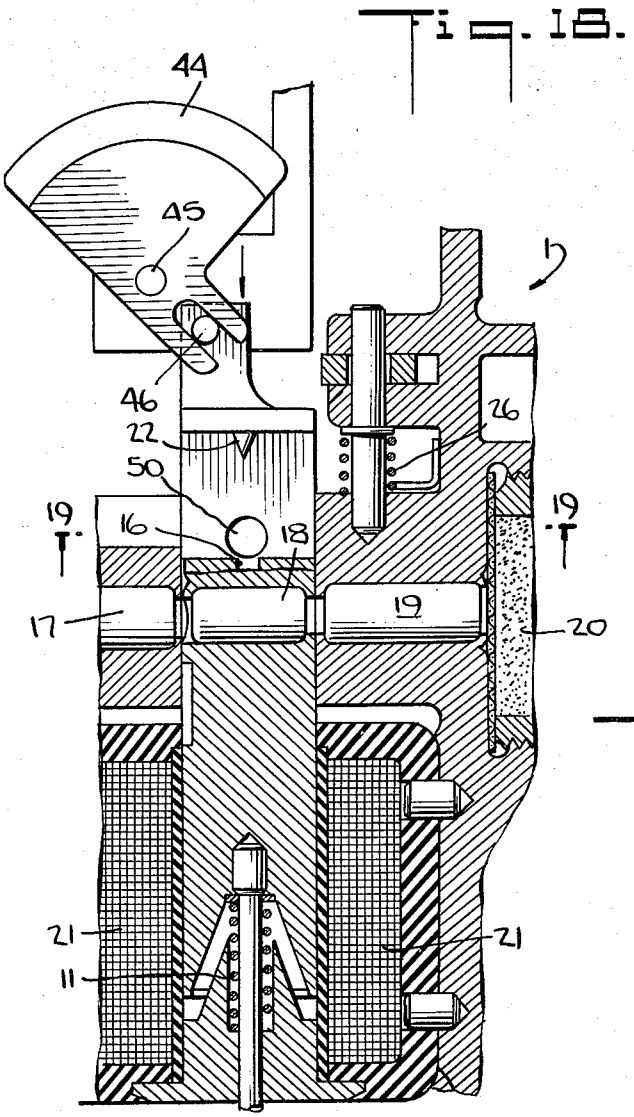
INVENTORS
CHARLES CRESCAS
SORRELL WEISMAN
JOSEPH SHARF
BY Kenyon & Kenyon
ATTORNEYS

INERTIAL ARMING DEVICE FOR A FUSE

This application relates to a fuse which is suitable for use in detonating a warhead or other explosive charge contained in an airborne body or missile. The invention relates more particularly to a fuse which has safety features and which is responsive to signals emanating from a ground position.

A missile or airborne body which is intended to explode upon reaching a target area is usually designed with two particular objectives in mind. The first of these is related to the primary function of the missile, namely, the destruction of the target to which it is directed. This function of the missile, of course, will not be achieved if the explosive charge carried by the missile fails to detonate. Thus, the first of the two objectives is the assurance that the explosive charge within the missile will detonate when the target area is reached.

The above objective would be very simple to achieve were it not for the fact that an equally important consideration is the safety of the personnel who handle the missile before it is launched. Accordingly, the second objective involved in the design of a missile relates to the precautions which must be taken in order to avoid the possibility of premature detonation in or around the launching area.

Both of the above objectives are attained in accordance with this invention by use of a new and unique fuse.

Accordingly, it is an object of this invention to provide a fuse which provides a detonation suitable for propagating the explosive warhead contained in the missile.

It is a further object of this invention to provide a fuse which cannot produce a detonation capable of propagating the missile warhead until it is airborne.

It is another object of this invention to provide a fuse, capable of propagating the missile warhead, which embodies a safety feature which precludes premature detonation until a command signal is received from the ground.

It is another object of this invention to provide a fuse which permits safe storage and handling of a missile containing a warhead.

The fuse of this invention is designed so that in its fully armed position it requires the closing of an electrical switch before its explosive train is detonated. Such an electrical switch is conveniently located in the nose of the missile so that it is closed by the impact of the missile on the target.

Accordingly, it is a further object of this invention to provide a fuse which is responsive to impact of the missile in which it is disposed to provide a detonation which will, in turn, propagate the missile warhead.

Briefly stated, the fuse of the present invention is characterized by three conditions, safe, ready and armed and comprises an explosive train including a detonator, the said train being initially out of alignment; a solenoid which is responsive to electrical signals emanating from a ground position, the armature of said solenoid being spring-biased, an acceleration-responsive powerweight having a first position and a second position, and a spring-biased fork member which serves both to position said armature when said fuse is in the said ready position and also to support the powerweight in its said second position.

In the safe condition, the armature of the solenoid is spring-biased against and is interlocked with the powerweight which is located in the first position.

The solenoid is then energized, moving the armature against the spring-bias and out of contact with the powerweight. This frees the powerweight and permits it to move in response to acceleration of the missile.

The fork member is biased against the powerweight when the latter is in the first position. When so disposed, the fork member is an obstacle in the part of the armature, preventing the latter from moving through its full stroke under the urging of the solenoid.

The powerweight moves linearly from the first position to the second position in response to acceleration of the missile. After the powerweight has moved to its second position, the spring-biased fork member moves under the powerweight to support it. In its position under the powerweight, the fork member is out of the path of the armature.

The movement of the powerweight to its second position interrupts the electrical circuit through which the solenoid was energized. Thus, the armature is subjected solely to the influence of its bias spring, and accordingly moves away from the position previously held.

At this stage, the fuse is in the ready condition.

Upon a signal from the ground, the solenoid is actuated and the armature moves through its full stroke. A spring loaded detent pin, biased against the surface of the armature, is directed into a hole provided in the said armature, thereby locking the armature in position. In this condition of the fuse, the armed condition, the several parts of the explosive train of the fuse are fully aligned for the first time.

The detonator in the explosive train is responsive to a switch in the missile which is closed by impact with the target. Closing this switch thus explodes the detonator, and the entire explosive train is thereby propagated.

The invention will be more readily understood when taken in conjunction with the following drawings, in which:

FIG. 6 is an enlarged sectional view showing the relationship between the powerweight and the spring-biased fork member of the fuse when in the safe condition;

FIG. 8 is an enlarged sectional view of the portion of the fuse shown in FIG. 6 subsequent to actuation of the solenoid;

FIG. 11 is a perspective view of the powerweight and associated elements;

FIG. 12 is an elevational view, partly in section, of a portion of FIG. 11;

FIG. 18 is an enlarged sectional view of the fuse as shown in FIG. 5 when in the armed position;

FIG. 19 is an enlarged end elevational view, partly in section, of the fuse of FIG. 1, showing the detent pin seated in the armature, and FIG. 20 is a schematic drawing of the electrical circuitry of the fuse of FIG. 1.

Figure 2:
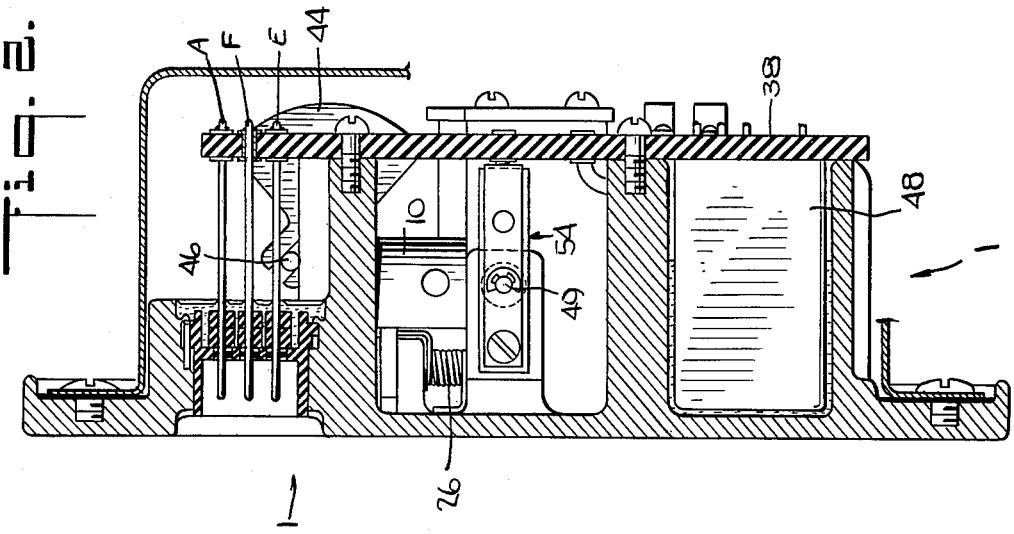
FIG. 2 is a cross-sectional elevational view of the fuse shown in FIG. 1.
Figure 1:
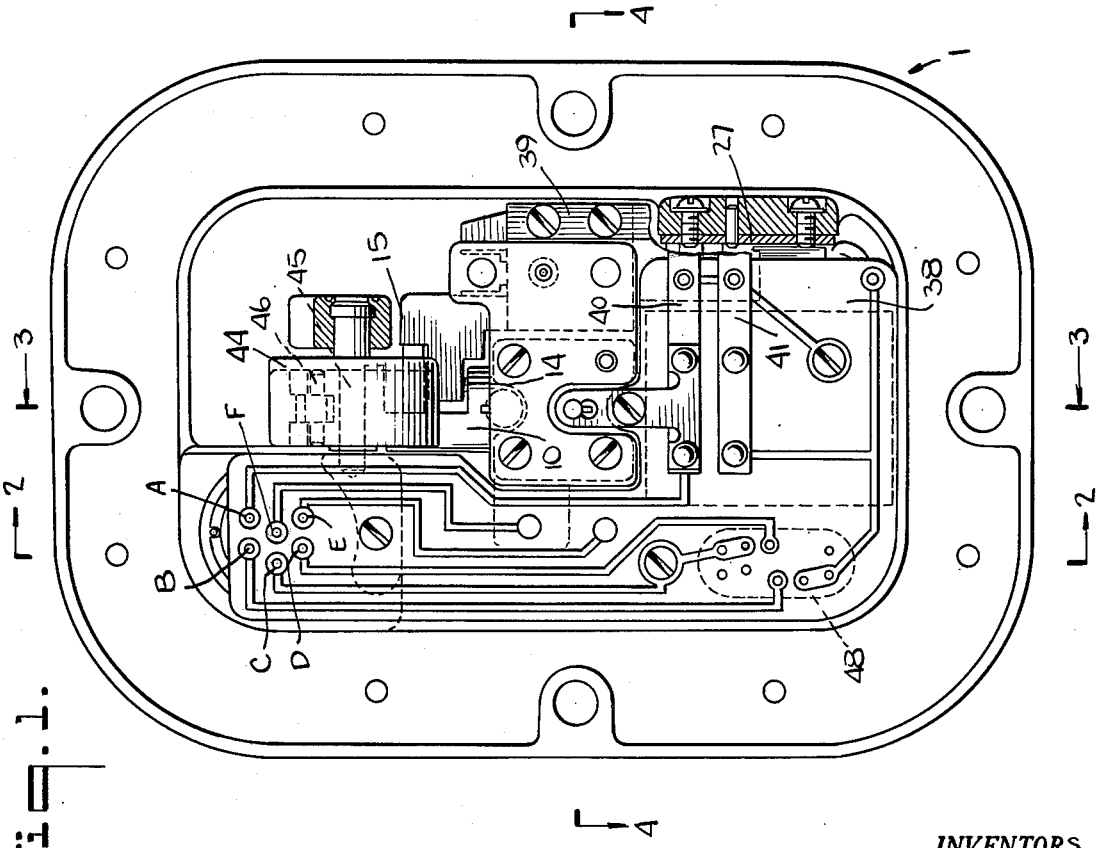
FIG. 1 is a plan view, partly in section, of one embodiment of the fuse of this invention.
Figure 3:
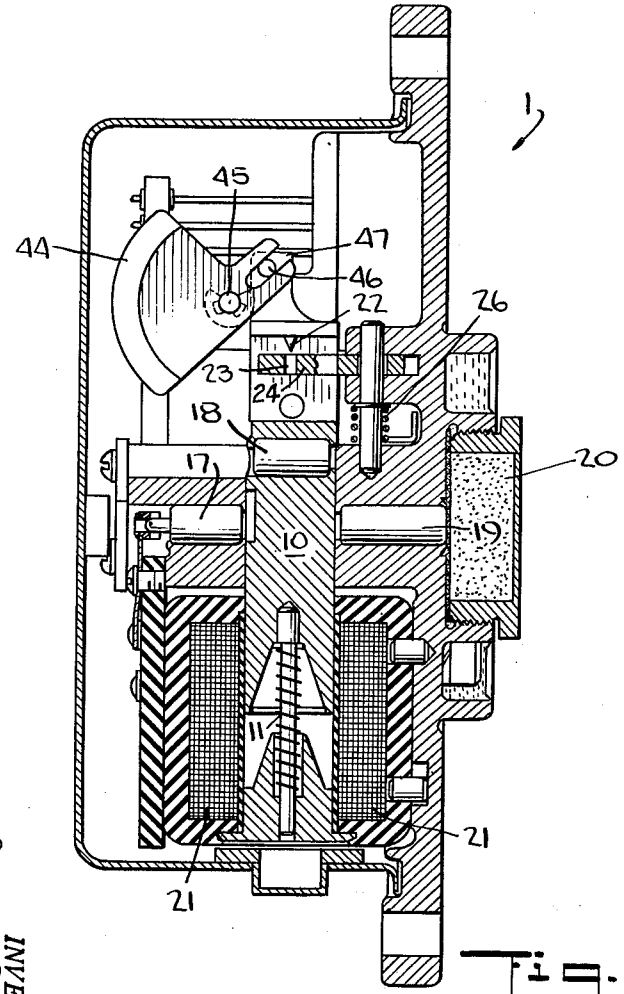
FIG. 3 is a cross-sectional elevational view of the fuse shown in FIG. 1.

With reference now more particularly to the drawings, FIG. 1 is a plan view of one embodiment of the fuse of this invention. FIGS. 2 and 3 are sectional views taken as shown in FIG. 1.

It is believed that a description of the operation of the fuse shown in FIGS. 1, 2 and 3 will be most helpful in understanding how the various parts and components coact. With reference to FIG. 3, the fuse 1 is shown in the safe condition. Armature 10 as shown in FIG. 3 is under the influence of bias spring 11.

Figure 4:
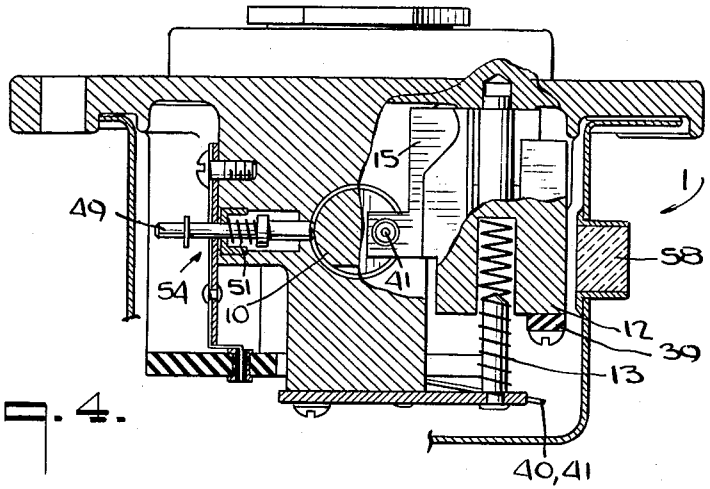
FIG. 4 is an end elevational view, partly in section, of the fuse shown in FIG. 1, showing the powerweight in its first position.
Figure 17:
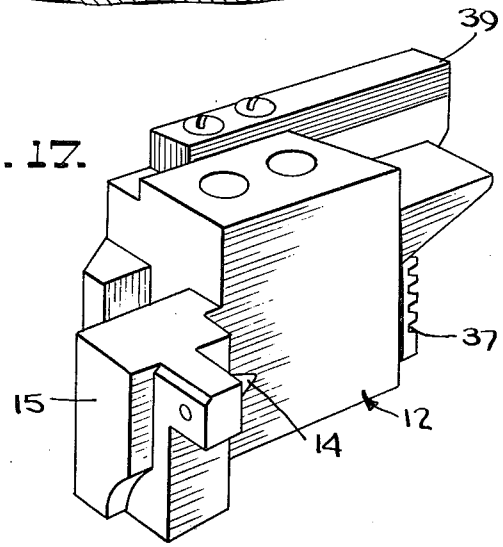
FIG. 17 is a perspective view of the powerweight of the fuse of FIG. 1.

FIG. 4 is a sectional view taken as shown in FIG. 1. Powerweight 12 is shown in its first position, being biased by the action of spring 13. The shape and configuration of powerweight 12 is best shown in FIG. 17. As shown in this drawing, powerweight 12 has a pin 14 attached to projection 15.

When the fuse is in its safe condition, the powerweight is in its first position. In this position, pin 14 of powerweight 12 is engaged in a hole 16 in armature 10. This condition in which armature 10 is under the influence of spring 11, is shown in detail in FIG. 5. When armature 10 and powerweight 12 are so interlocked, the fuse can be handled with relatively little danger of premature firing. This is due to the fact that, as shown in FIG. 3, the explosive train components, represented by detonator 17, plunger lead 18, lead 19 and booster cup assembly 20, are out of alignment. Consequently, inadvertent firing of detonator 17 could not result in a propagation of the entire explosive train.

The fuse in the condition shown in FIG. 3 may be safely stored and subsequently attached to a missile.

Upon proper positioning of the fuse in a missile, and upon placing the missile in launching position, the fuse is converted from the safe condition to one in which subsequent events will permit firing at the appropriate time. To this end, solenoid 21 is energized by closing a switch in a manner to be described in detail below. Energizing solenoid 21 causes axial movement of armature 10 downwardly in a direction opposite to that exerted by bias spring 11.

Figure 7:
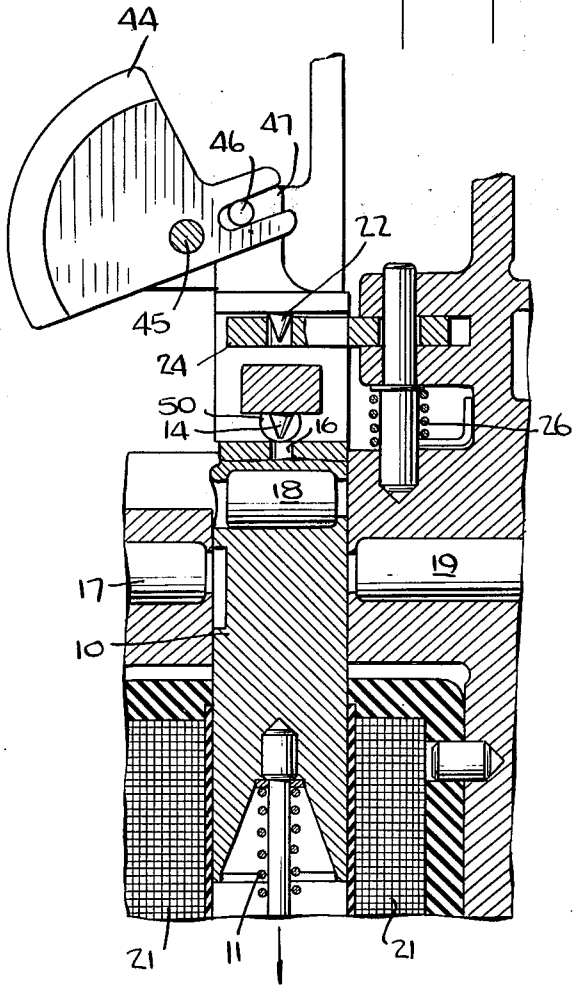
FIG. 7 is an enlarged sectional view of the fuse as shown in FIG. 5 subsequent to actuation of the solenoid.

Armature 10 is prevented from moving through its entire stroke by the engagement of pin 22 thereof with hole 23 of fork 24. Armature 10 is thus moved to the position shown in FIG. 7.

Pin 22 and hole 23 are not in perfect alignment. There is a slight offset between these two components which results in a camming action on fork member 24. This is best shown by reference to FIGS. 6 and 8.

Fork member 24 is rotatable about axis 25. As shown in FIG. 6, fork member 24 is biased against powerweight 12 by the action of spring 26. The slight offset between pin 22 and hole 23 is also shown in FIG. 6.

Upon movement of armature 10 as a result of energizing solenoid 21, pin 22 cams fork member 24 and thus moves it clockwise to the position shown in FIG. 8. In this position, fork member 24 is moved away from powerweight 12.

Thus, the engagement of pin 22 with hole 23 serves two purposes. First, the possibility of aligning the explosive train is prevented by stopping the movement of armature 10. Secondly, fork member 24 is moved out of frictional engagement with powerweight 12. In its previous position, fork 24 exerted a frictional restraint against powerweight 12, thereby preventing its movement.

At this point, the fuse is prepared for subsequent events which depend upon launching of the missile.

Figure 10:
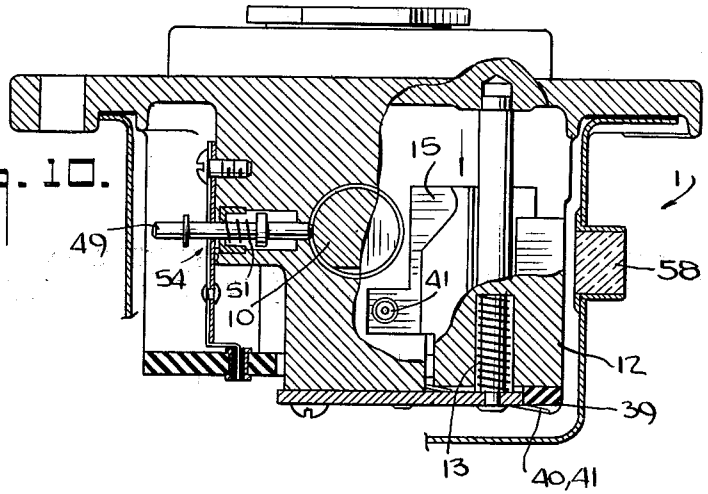
FIG. 10 is an end elevational view partly in section of the portion of the fuse shown in FIG. 4 with the powerweight in its second position.

When the missile is launched, the forces of acceleration are exerted on powerweight 12, tending to cause it to move in a direction which would compress spring 13. As shown in FIGS. 4 and 10, powerweight 12 moves from bottom to top. FIG. 10 depicts powerweight 12 in its second position. It is to be understood that the fuse is mounted on the missile so that acceleration forces resulting from launching of the missile have a substantial component parallel to the permitted direction of movement of powerweight 12.

Figure 15:
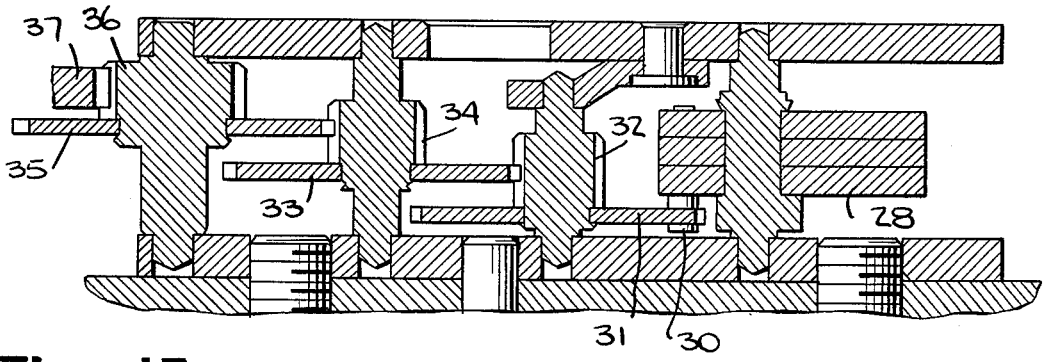
FIG. 15 is a sectional view of FIG. 13.
Figure 13:
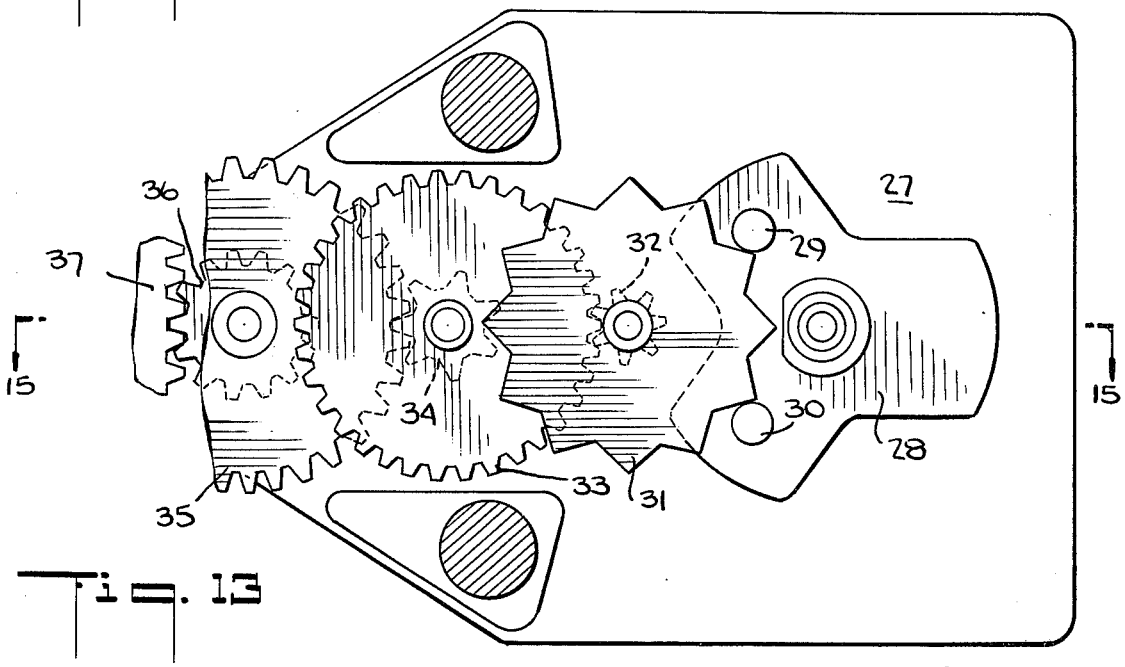
FIG. 13 is a plan view of the gear train and escapement employed in the fuse of FIG. 1.
Figure 14:
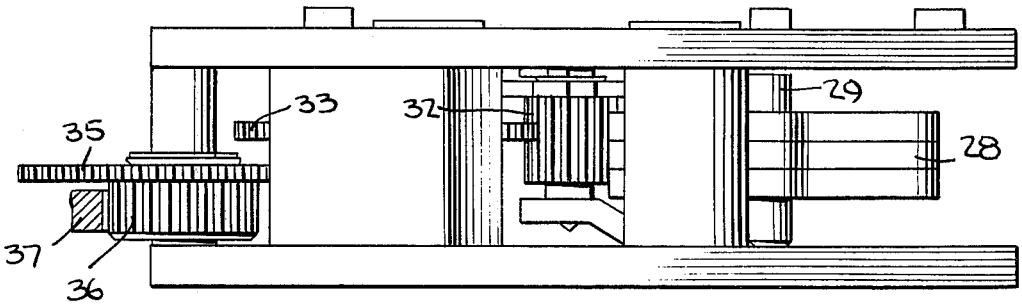
FIG. 14 is an elevational view of FIG. 13.

To insure that the acceleration of the missile exceeds a certain minimum in terms of magnitude and duration, movement of powerweight 12 is controlled by an escapement 27 as shown in FIGS. 13, 14 and 15. Escapement 27 includes pawl 28, pallets 29 and 30, and scape wheel 31. These elements of escapement 27 function in the known manner, thereby causing scape wheel 31 to rotate intermittently at a predetermined rate.

The rotation of scape wheel 31 is transmitted through meshing gears 32, 33, 34, 35 and 36. As shown in FIGS. 11 and 17, rack 37 on powerweight 12 is engaged with gear 36. Accordingly, escapement 27 governs the movement of powerweight 12 from its first position to its second position.

The movement of powerweight 12 is terminated by stop plate 38. This is best shown in FIG. 11. Just prior to the termination of movement of powerweight 12, insulated knockoff strip 39 on powerweight 12 lifts the two normally closed knife elements 40 and 41. As shown in FIG. 12, lifting knife element 41 opens the previously closed switch 52 formed of contacts 42 and 43. The movement of a knife element 40 opens switch 53 composed of a similar pair of contacts, not shown.

As will be described more fully in connection with FIG. 20, the separation of contacts 42 and 43, caused by upward movement of knife element 41, deenergizes solenoid 21 even though the switch which originally energized solenoid 21 still remains closed.

Figure 16:
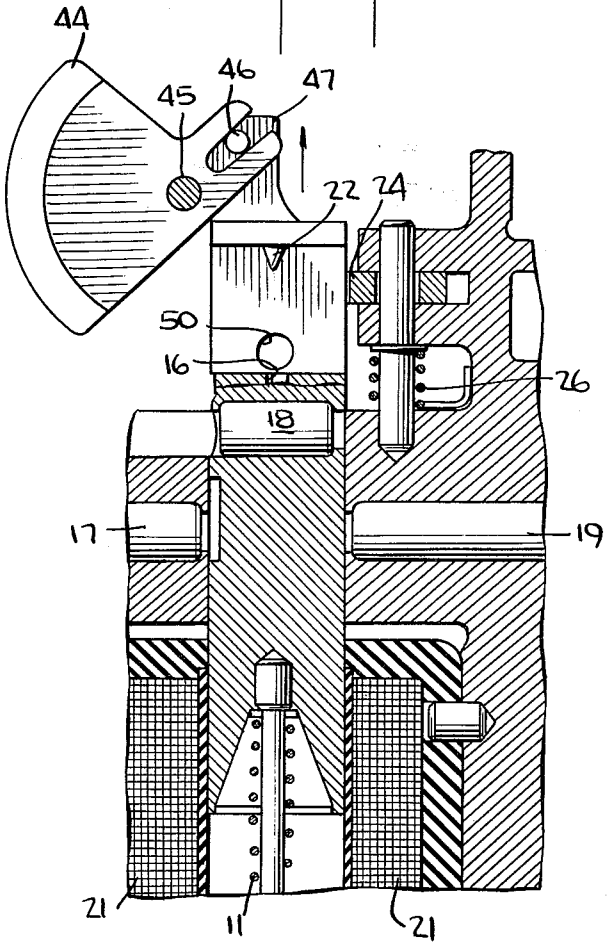
FIG. 16 is an enlarged sectional view of the fuse as shown in FIG. 5 when in the ready position.

The deenergization of solenoid 21 causes armature 10 to move under the influence of bias spring 11 to the condition shown in FIG. 16. As shown in FIG. 16, such movement is represented by the armature 10 moving from bottom to top. The condition shown in FIG. 16 is the same as that shown in FIG. 5 except that powerweight 12, having moved to its second position, is not engaged.

This movement of armature 10 frees fork 24 which was previously held in position by pin 22. Fork 24 is thus caused to rotate about axis 25 by the movement of bias spring 26. Since the powerweight is now in an elevated position with respect to fork 24, the condition shown in FIG. 9 results wherein fork 24 locks powerweight 12 in its second position.

Switch 53, which was closed prior to the upward movement of knife element 40, completed a short circuit around detonator 17. That is to say, detonator 17, which is designed to be exploded by an electrical signal, was protected from such an eventuality by closed switch 53. Since the upward movement of knife element 40 opened switch 53, the detonator is placed in condition for firing. At this point, the fuse is in the ready condition.

Missile safety when the fuse is in the ready condition is assured because plunger lead 18 is out of alignment with detonator 17 and lead 19. Once again, as in the safe condition, if detonator 17 were inadvertently fired, there would be no propagation of this explosion through the fuse.

Figure 5:
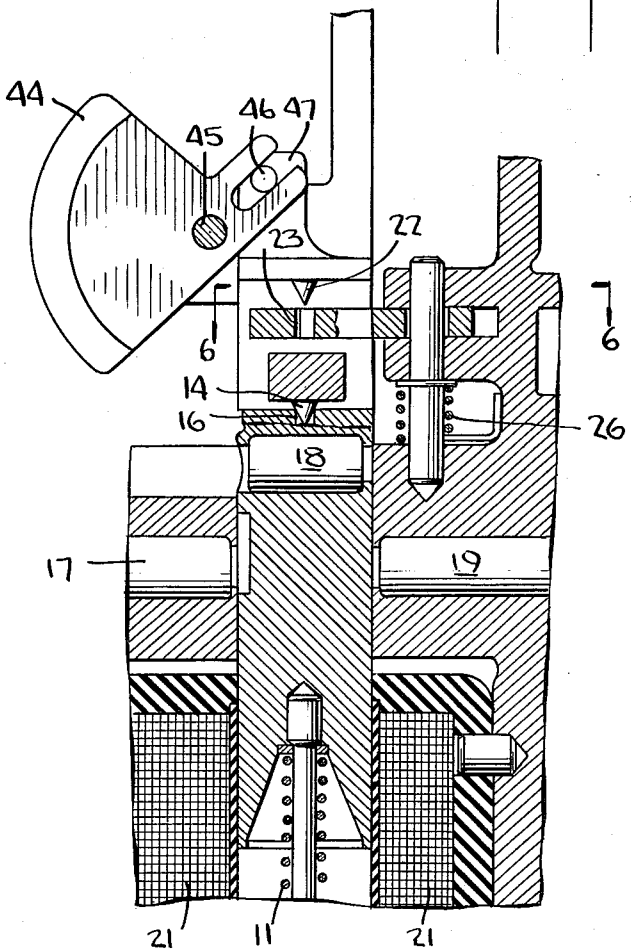
FIG. 5 is an enlarged sectional view of a portion of the fuse when in the safe condtion.

Counterbalance 44 precludes movement of armature 10 into armed condition by reason of acceleration forces during the flight of the missile. As shown in FIG. 5, for example, counterbalance 44 is pivoted about axis 45 and is connected to armature 10 by means of pin 46 which engages slot 47. As can be seen from comparison of FIGS. 5 and 7, movement of armature 10 in one direction results in movement of counterbalance 44 in the opposite direction. Thus, any acceleration force which would tend to cause armature 10 to move in a direction against the bias of spring 11 would also tend to cause counterbalance 44 to move in an opposite direction. In this fashion, armature 10 is prevented from moving under the influence of such acceleration forces. This is a necessary safety feature since otherwise it would have been possible for armature 10 to move against the bias of spring 11, thereby aligning the explosive train and arming the fuse prematurely.

Placing the fuse in the armed condition is accomplished by energizing relay 48. The operation of relay 48 in turn energizes solenoid 21 through a circuit which is parallel to the one which was opened by the upward movement of knife element 41. Accordingly, armature 10 moves in a direction against the bias of spring 11.

Figure 9:
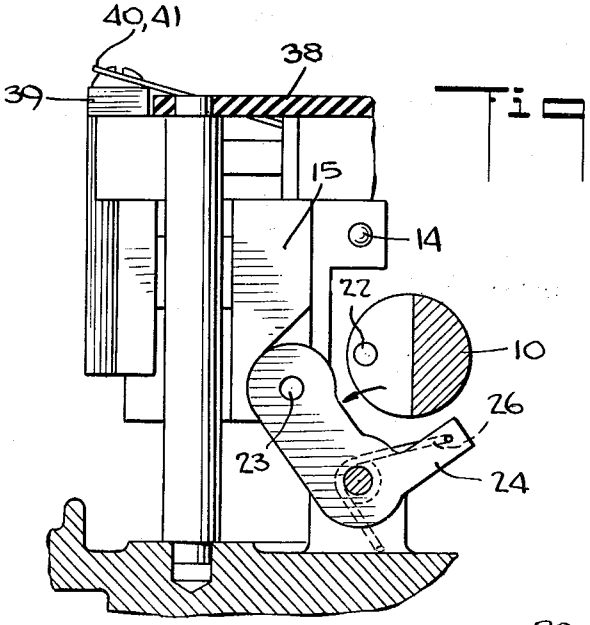
FIG. 9 is an enlarged sectional view of the fuse as shown in FIG. 6 with the powerweight locked in its second position by the spring-biased fork member.

At this stage, as shown in FIG. 16, both powerweight 12 and fork 24 have been withdrawn from the path of armature 10. Powerweight 12 is out of the way because it has moved to its second position and fork 24 is out of the way because it has rotated under the influence of spring 26, as shown in FIG. 9. Thus, armature 10 is free to move through a full stroke. The condition of the fuse following the movement of armature 10 through its full stroke is shown in FIG. 18. As seen in this drawing, the explosive train is now in alignment.

Detent pin 49 is caused to enter hole 50 in armature 10 by the action of bias spring 51. This action of detent pin 49 causes armature 10 to be locked in position. This condition is depicted in FIG. 19. As shown in FIGS. 4 and 10, for example, detent pin 49 previously was engaged with the surface of plunger 10.

In addition to detent pin 49, locking armature 10 in position, the movement of detent pin 49 also closes an arming switch 54 which provides a circuit for telemetering purposes. This is described in conjunction with FIG. 20, below.

The fuse is now in the armed condition.

FIG. 20 is a schematic diagram of the electrical circuitry of the fuse of FIG. 1. Shown in this drawing are electrical power source 55, for example, a group of DC storage batteries. Terminals A through F represent printed circuit terminals having letter references as shown in FIG. 1. As shown in the schematic drawing, terminal C is connected to ground.

Correlating the drawing of FIG. 20 with the foregoing description, the first step is the connection of terminal E to the positive side of power source 55. This energizes solenoid 21 through the closed switch 52.

The next step of importance in connection with FIG. 20 is the movement of powerweight 12 to its second position. As described above, this causes switches 52 and 53 to be opened. As shown in FIG. 20, opening of switch 52 deenergizes solenoid 21.

Relay 48 is caused to operate by connecting terminals B and D across a voltage source on the ground. Operation of relay 48 thus closes switch 56 which remains latched. As may be seen, solenoid 21 is thus again energized, but this time through switch 56 rather than through switch 52, which is in the open condition.

The detonator 17 is represented in FIG. 20 as an ohmic resistance. In order for detonator 17 to be exploded, switch 57 must be closed. This switch is one which is directly related to the impact of the missile on the target area. Thus, for example, switch 57 might be a pressure-sensitive switch located in the nose of the missile. Thus, upon impact of the missile with the target, switch 57 is closed, thereby exploding detonator 17, and propagating the entire explosive train.

It is noted that switch 53, if in its closed position, would preclude subjecting detonator 17 to a potential difference. As described above, switch 53 is opened by movement of a powerweight 12 to its second position.

A window 58 is provided as shown in FIGS. 4 and 10. Window 58 serves as an additional safety feature in that the position of powerweight 12 may be determined by locking therethrough. Thus, if the view window 58 indicates that powerweight is in its first position, this provides assurance that the fuse exploded train cannot be inadvertently propagated. If, on the other hand, examination of window 58 indicates that powerweight 12 is in its second position, the fuse is discarded and not used.

What has been described above is an illustrative example of the fuse of the present invention. It is to be understood that variations may be made therein by one skilled in the art, without departing from the spirit and scope of this invention.

We claim:

1. A fuse suitable for use in a body to be accelerated toward a target area comprising a base, a solenoid including a spring-biased armature disposed in said base, an explosive train including in sequence a detonator disposed in said base, a lead plunger contained in said armature, a lead plug contained in said base, and a booster contained in said base, said explosive train being initially out of alignment by reason of the position of the lead contained in said armature, a powerweight linearly movable from a first position to a second position in response to acceleration of said body, said powerweight being in interlocking engagement with said armature when said powerweight is in said first position and said armature is in a position governed solely by the urging of its bias spring, an escapement connected to said powerweight through a gear train to govern the movement of said powerweight from said first position to said second position, a spring-biased fork member responsive to the position of said powerweight, said fork member being biased against said powerweight and serving to engage said armature as it is moved under the influence of said solenoid when said powerweight is in said first position, the movement of said powerweight to said second position permitting said fork member to move out of the path of said armature and into engagement with said powerweight in its second position to serve as a support therefor, such that said explosive train becomes aligned upon movement of the armature out of interlocking relationship with said powerweight, followed sequentially by movement of said powerweight from said first position to said second position, movement of said fork member out of the path of said armature, and movement of said armature whereby said explosive train is aligned and the fuse is armed.

2. A fuse suitable for use in a body to be accelerated toward a target area comprising a base, a solenoid including a spring-biased armature disposed in said base, an explosive train including in sequence a detonator disposed in said base, a lead plunger contained in said armature, a lead plug contained in said base, and a booster contained in said base, said explosive train being initially out of alignment by reason of the position of the lead contained in said armature, a powerweight linearly movable from a first position to a second position in response to acceleration of said body, said powerweight being in interlocking engagement with said armature when said powerweight is in said first position and said armature is in a position governed solely by the urging of its bias spring, a first electrical circuit including switch contacts for energizing said solenoid, the movement of said powerweight from said first position to said second position causing said switch to open, a second electrical circuit including a normally open relay-operated switch for energizing said solenoid, an escapement connected to said powerweight through a gear train to govern the movement of said powerweight from said first position to said second position, a spring-biased fork member responsive to the position of said powerweight, said fork member being biased against said powerweight and serving to engage said armature as the armature is moved under the influence of said solenoid when said powerweight is in said first position, the movement of said powerweight to said second position permitting said fork member to move out of the path of said armature and into engagement with said powerweight in its second position to serve as a support therefor, such that said explosive train becomes aligned upon movement of said armature out of interlocking relationship with said powerweight as a result of energizing said solenoid through the said first electrical circuit, the movement of said armature being stopped by engagement with said fork member, followed sequentially by movement of said powerweight from said first position to the second position whereby said solenoid is deenergized by the opening of said switch contacts, movement of said fork member out of the path of said armature and into engagement with said powerweight in its second position to serve as a support therefor, energizing said relay-operated switch thereby closing said switch and energizing said solenoid, and movement of said armature whereby said explosive train is aligned and the fuse is armed.

3. The fuse of claim 2 in which said fork member is cammed away from said powerweight in its first position by movement of said armature into engagement with said fork member as the result of energizing said solenoid through said first electrical circuit, the movement of said powerweight to said second position deenergizing said solenoid and causing said armature to return to its spring-biased position whereby said fork member is free to move out of the path of said armature and into engagement with said powerweight in its second position.

4. A fuse suitable for use in a body to be accelerated toward a target area comprising a base, a solenoid including a spring-biased armature disposed in said base, an explosive train including in sequence a detonator responsive to an electrical signal disposed in said base, a lead plunger contained in said armature, a lead plug contained in said base, and a booster contained in said base, said explosive train being initially out of alignment by reason of the position of the lead contained in said armature, a first electrical circuit including a first switch connected accross said detonator as a short-circuit, a powerweight linearly movable from a first position to a second position in response to acceleration of said body, said powerweight being in interlocking engagement with said armature when said powerweight is in said first position and said armature is in a position governed solely by the urging of its bias spring, a second electrical circuit including switch contacts for energizing said solenoid, the movement of said powerweight from said first position to said second position causing said switch to open, a third electrical circuit including a normally open relay-operated switch for energizing said solenoid, an escapement connected to said powerweight through a gear train to govern the movement of said powerweight from said first position to said second position, a spring-biased fork member responsive to the position of said powerweight, said fork member being biased against said powerweight and serving to engage said armature as it is moved under the influence of said solenoid when said powerweight is in said first position, said fork member being cammed away from said powerweight in its first position by movement of said armature as a result of energizing said solenoid through said second electrical circuit, the movement of said powerweight to said second position opening said switch contacts and deenergizing said solenoid thereby causing said armature to return to its spring-biased position whereby said fork member is free to move out of the path of said armature and into engagement with said powerweight in its second position under the urging of its bias spring, the movement of said powerweight to said second position also opening said first switch thereby removing said short-circuit from across said detonator and rendering said detonator susceptible to explosive by an electric impulse, such that said explosive train becomes aligned upon movement of said armature out of interlocking relationship with said powerweight as a result of energizing said solenoid through said first electrical circuit, the movement of said armature being stopped by engagement with said fork member, followed sequentially by movement of said powerweight from said first position to said second position whereby said solenoid is deenergized by the opening of said switch contacts, movement of said fork member out of the path of said armature and into engagement with said powerweight in its second position to serve as a support therefor, energizing said relay-operated switch thereby closing said switch and energizing said solenoid, the movement of said armature through its full stroke whereby said explosive train is aligned and the fuse is armed.

* * * * *